United States Patent [19]

Fujiwara et al.

[11] 4,406,321

[45] Sep. 27, 1983

[54] ELECTROMAGNETIC STIRRER FOR USE IN A CONTINUOUS STEEL CASTING APPARATUS

[75] Inventors: Koichi Fujiwara, Takarazuka; Takeo Shiozawa, Kakogawa; Katsumi Miki, Hyogo; Masahiko Uchimura, Kobe; Kazunori Miyajima, Kakogawa; Yasuo Tonouchi, Matsusaka, all of Japan

[73] Assignee: Kabushiki Kaisha Kobe Seiko Sho, Kobe, Japan

[21] Appl. No.: 250,037

[22] Filed: Apr. 1, 1981

[30] Foreign Application Priority Data

Apr. 1, 1980 [JP] Japan ..... 55-43293

[51] Int. Cl.[3] ..... B22D 11/10; B22D 11/00

[52] U.S. Cl. ..... 164/504; 164/468

[58] Field of Search ..... 164/467, 468, 499, 504

[56] References Cited

U.S. PATENT DOCUMENTS 4,146,078 3/1979 Rummel et al. ..... 164/467

FOREIGN PATENT DOCUMENTS 2825035 12/1978 Fed. Rep. of Germany .
362804 12/1973 Sweden .
818469 6/1976 U.S.S.R. .

*Primary Examiner*—Gus T. Hampilos
*Assistant Examiner*—Peter Martine
*Attorney, Agent, or Firm*—Oblon, Fisher, Spivak, McClelland & Maier

[57] ABSTRACT

An electromagnetic stirrer for use on a continuous steel casting apparatus, the stirrer employing a coil assembly including a pair of exciting cage coils energized by dual-phase alternate current, each having a hollow conductor interiorly defining a cooling water passage and which are folded and arranged in a compact form.

2 Claims, 5 Drawing Figures

ELECTROMAGNETIC STIRRER FOR USE IN A CONTINUOUS STEEL CASTING APPARATUS

BACKGROUND OF THE INVENTION

1. Field of the Invention

This invention relates to an electromagnetic stirrer intended for use, for example, in a continuous steel casting apparatus for electromagnetically generating stirring motion in molten steel within a copper mold or molten steel underneath a solidified shell of continuously cast strand (hereinafter referred to as "c.c strand" for brevity).

2. Description of the Prior Art

In electromagnetic stirrers, the manner in which an exciting coil is wound or folded is very important from the standpoint of high electromagnetic stirring effect and compactness of construction, and it is necessary to provide a mechanism for constantly cooling the exciting coil.

SUMMARY OF THE INVENTION

An object of the present invention to provide an electromagnetic stirrer employing a coil assembly including a pair of exciting coils in the form of a cage which can be held so as to form a small gap with the outer surface of a casting mold or a continuously cast strand to attain high magnetic permeability for efficient electromagnetic stirring operation.

A further object of the present invention is to provide an electromagnetic stirrer of the type mentioned above, in which upper and lower horizontal turn portions of the cage coils can be arranged in overlapping relation to provide a compact coil assembly.

A still further object of the present invention is to provide an electromagnetic stirrer of the type mentioned above, in which each cage coil is formed of a hollow conductor interiorly providing a cooling water passage.

According to the present invention, these objects are attained by an electromagnetic stirrer which includes: a coil assembly having of a pair of exciting coils each formed by folding into a cage form a hollow conductor interiorly defining a cooling water passage, each exciting coil of cage form having a pair of opposingly spaced vertical side portions each including a plurality of parallel upright coil portions, a pair of upper horizontal turn portions consisting of a plural number of horizontal coil portions connecting upper ends of the upright coil portions in the opposing side portions and turned in parallel relation with each other and in the form of earflaps around the opposite sides of a casting mold or a continuously cast strand, and a pair of lower horizontal turn portions including a plurality of horizontal coil portions connecting lower ends of the upright coil portions in the opposing side portions and turned in parallel relation with each other and in the form of earflaps around the opposite sides of the casting mold or continuously cast strand, the cage coils being assembled one within the other with the vertical side portions of the two coils disposed perpendicular to each other to form four upright sides of the coil assembly and with the upper and lower horizontal turn portions of the two coils respectively in overlapping relation with each other, and an iron core mounted around the upright side portions of the two coils between the upper and lower horizontal turn portions thereof, the exciting coils being applied with dual-phase alternate current with a phase differential of about $\pi/2$ in electric angle.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

In the accompanying drawings.

DETAILED DESCRIPTION OF THE PREFERRED EMBODIMENT

Reference is now made to the accompanying drawings which show electromagnetic stirrers according to the present invention, which is driven by dual-phase alternate current and which is provided with a pair of exciting coils of suitably bent forms for the respective phases.

Figure 1:
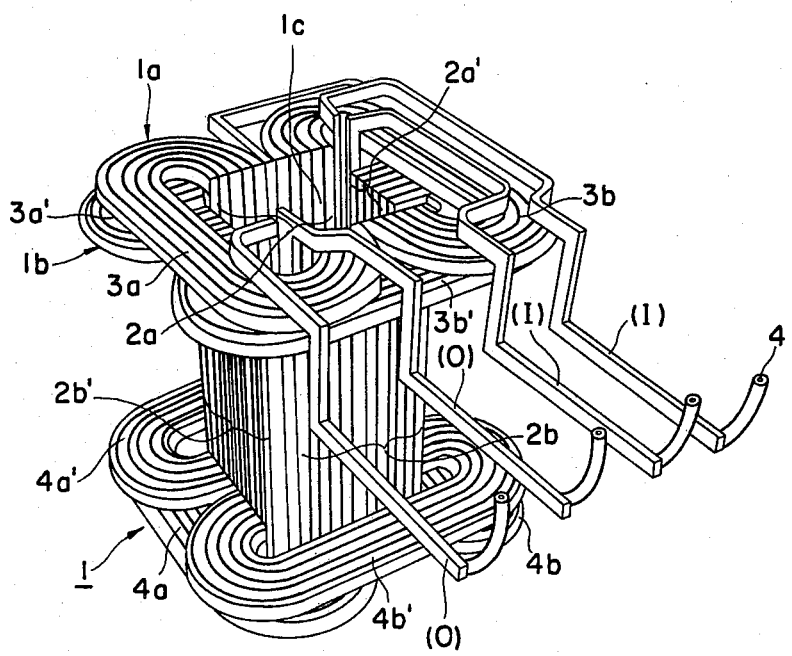
FIG. 1 is a perspective view of exciting coils folded and assembled according to the present invention.

Referring to FIG. 1, illustrated there is a combination of coils 1*a* and 1*b* of a cage form (hereinafter referred to as "cage coil" for brevity) which is formed by suitably bending a pair of conductors. As illustrated, magnetic coil 1 is centrally provided with a vertical shaft or passage 1*c* of square shape in cross-section for receiving therein a copper body of a casting mold 2 (indicated in phantom in FIGS. 2 and 3) or for passing therethrough a cast strand which is continuously drawn out of the mold 2.

Cage coils 1*a* and 1*b* slightly differ from each other in dimensions but are substantially the same in shape. Each cage coil 1*a*, 1*b* has a pair of parallel vertical side portions 2*a* and 2*b* or 2*a'* and 2*b'* on opposite sides of passage 1*c*, the side portions each containing a plurality of upright parallel coil portions. The upper and lower ends of opposing upright portions 2*a* and 2*b* or 2*a'* and 2*b'* are connected respectively by a pair of horizontal upper turn portions 3*a* and 3*b* or 3*a'* and 3*b'* and a pair of horizontal lower turn portions 4*a* and 4*b* or 4*a'* and 4*b'* in the form of earflaps which are turned around opposite sides of the casting mold or c.c. strand. The two cage coils 1*a*, 1*b*, which are arranged in this manner are fitted one in the other such that upright coil portions 2*a*, 2*b*, 2*a'* and 2*b'* form the four sides of the coil assembly and upper and lower horizontal portions 3*a*, 3*b* and 4*a* and 4*b* of one cage coil 1*b* are overlapped on the outer sides of upper and lower horizontal portions 3*a'*, 3*b'* and 4*a'* and 4*b'* of the other cage coil 1*b* as shown in FIG. 1. An iron core 3 is mounted around the thus assembled two cage coils 1*a* and 1*b* as particularly shown in FIGS. 2 and 3.

Figure 4:
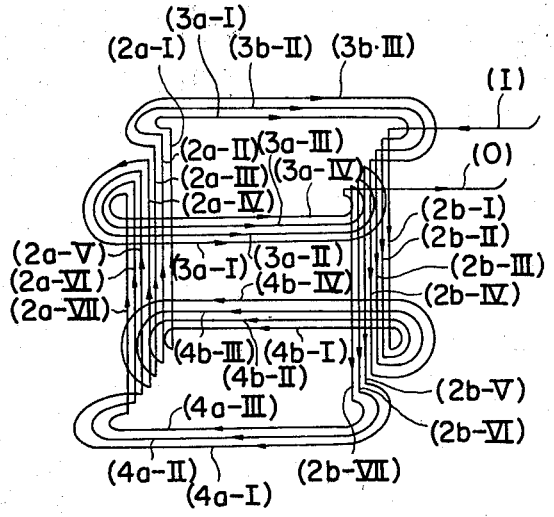
FIG. 4 is a schematic view illustrating the sequence in which one coil is folded into a cage form.

The manner in which coils 1*a* and 1*b* are wound in a cage form is schematically shown in FIG. 4, in which the respective arrows indicate the sequence of coil winding. Following the arrows, for example, coil 1*a* is wound in the following order: a head end (I)→ a right-hand upright portion (2*b*-I)→ a lower horizontal portion on remote side (4*b*-I)→ a left-hand upright portion (2*a*-I)→ an upper horizontal portion on remote side (3*b*-I)→(2*b*-II)→(4*b*-II)→(2*a*-II)→(3*b*-II)→(2*b*-III)→(4*b*-III)→(2*a*-III)→(3*b*-III)→(2*b*-IV)→(4*b*-IV)→(2*a*-IV)→ an upper horizontal portion on near side (3*a*-I)→ a right-hand upright portion (2*b*-V)→ a lower horizontal portion on near side (4*a*-I)→(2*a*-5)→(3*a*-2)→(2*b*-VI)→(4*a*-II)→(2*a*-VI)→(3*a*-III)→(2*b*-VII)→(4*a*-III)→(3*a*-IV)→ a tail end (0).

Figure 2:
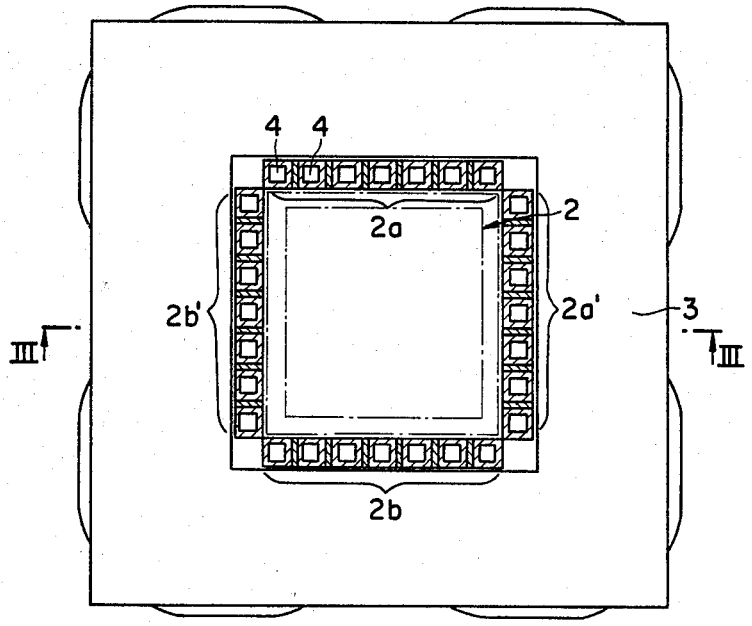
FIG. 2 is a horizontal section showing an iron core mounted around the magnetic coil of FIG. 1.
Figure 3:
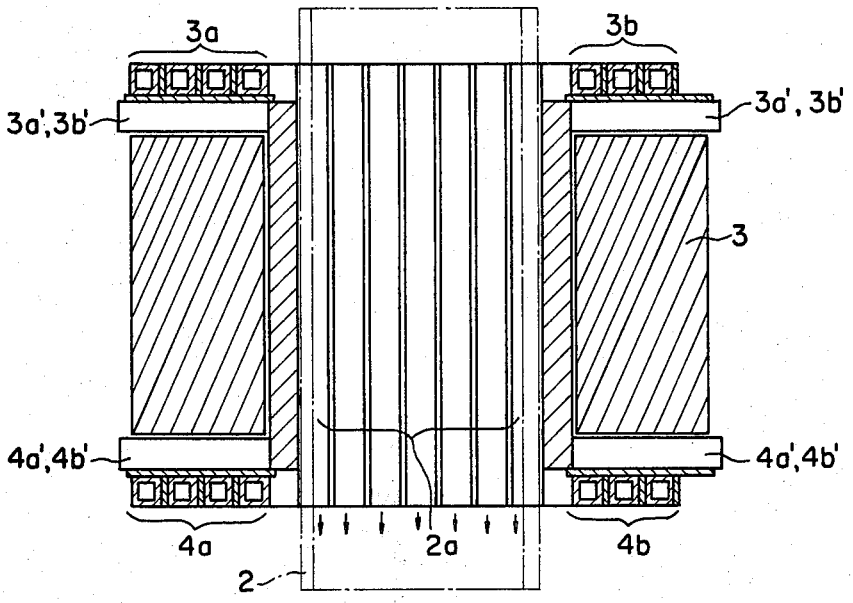
FIG. 3 is a sectional view taken along line III—III of FIG. 2.
Figure 5:
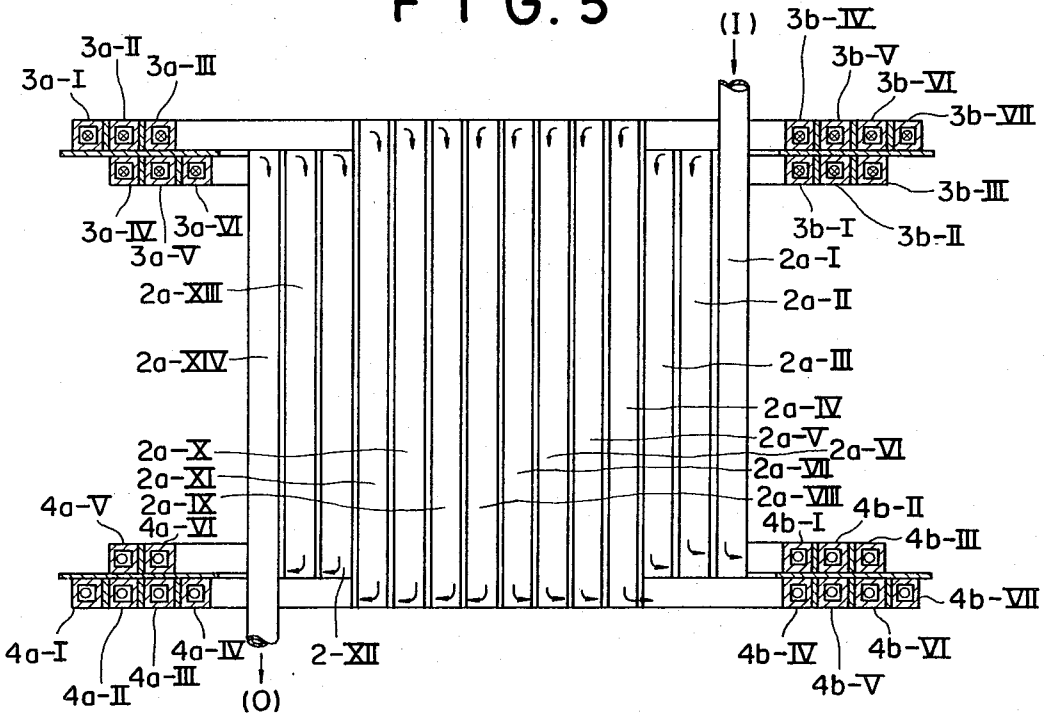
FIG. 5 is a vertical sectional view of another embodiment having upper and lower horizontal turn portions arranged in double layers.

In magnetic coil assembly 1 shown in FIGS. 1 to 3, upper and lower horizontal turns 3*a*, 3*b*; 3*a'*, 3*b'*; 4*a*, 4*b*; 4*a'*, 4*b'* of cage coils 1*a* and 1*b* are each formed in a single layer. However, according to the present invention, it is possible to employ a construction which has the respective horizontal turn portions arranged in a plurality of layers as shown in FIG. 5. Such an arrangement is advantageous in the production of steel castings of large sectional areas, which requires an electromagnetic stirrer of a larger size with a greater number of upright coil portions 2*a*, 2*a'*, 2*b*, 2*b'* . . . . and thus with greater numbers of upper and lower horizontal turn portions. The embodiment of FIG. 5 is useful particularly for reducing lateral bulges of the horizontal turn portions which would otherwise have to be stuck out to a considerable degree.

FIG. 5 is a sectional view similar to FIG. 3, taken along line III—III of FIG. 2, and shows half of one cage coil with the respective coil portions labelled correspondingly. As illustrated, the earflap-like horizontal turn portions are arranged in two layers in this particular embodiment. In this case, the conductor is folded according to the following sequence, except for the other half of the coil which is omitted from illustration.

A head end of an a upright portion (2*a*-I)→ an inner turn of right-hand lower horizontal turns (4*b*-I)→ an inner turn of right-hand upper horizontal turn (3*b*-I)→(2*a*-II)→(4*b*-II)→(3*b*-II)→(2*a*-III)→(4*b*-III)→(3*b*-III)→(2*a*-IV)→ an outer turn of right-hand horizontal turns (4*b*-IV)→ an outer turn of right-hand upper horizontal turns (3*b*-IV)→(2*a*-V)→ an outer turn of right-hand lower horizontal turns (4*b*-V)→(3*b*-V)→(2*a*-VI)→ an outer turn of right-hand lower horizontal turns (4*b*-VI)→(3*b*-VI)→(2*a*-VII)→(4*b*-VII)→(3*b*-VII)→(2*a*-VIII)→ an outer turn of left-hand lower horizontal turns (4*a*-I)→(3*a*-I)→(2*a*-IX)→(4*a*-II)→(3*a*-II)→(2*a*-X)→(4*a*-III)→(3*a*-III)→(2*a*XI)→(4*a*-IV)→ an inner turn of left-hand upper horizontal turns (3*a*-IV)→(2*a*-VII)→ an inner turn of left-hand lower horizontal turns (4*a*-V)→(3*a*-V)→(2*a*-VIII)→(4*a*-VI)→(3*a*-VI)→(2*a*-XIV)→ a tail end.

Upon passing sine wave alternate current through the thus arranged cage coils 1*a* and 1*b* with a phase differential of $\pi/2$ in electric angle, a rotary magnetic field is produced in the molten steel in casting mold 2 or in a c.c. strand, thereby imparting horizontal rotational movements to the molten steel. The conductor of each cage coil is in the form of a hollow tube to provide a passage 4 of cooling water.

As is clear from the foregoing particular description of the preferred embodiments, the electromagnetic stirrer of the present invention which is intended for use in a continuous casting line is of dual-phase alternate current type combining two cage coils in such a manner that their upper and lower horizontal turn portions are held in overlapping relation with each other. In addition, each coil is formed of a hollow conductor which is interiorly provided with a cooling water passage, so that the exciting coil assembly requires a smaller space and can dispense with any special cooling mechanism. Thus permitting a compact stirrer. Further, the upright portions on four sides of the magnetic coil assembly can be held so as to form a small gap with the copper wall surfaces of the casting mold or the surfaces of a c.c. strand to ensure high permeability of the magnetic field to the molten steel for effective electromagnetic stirring.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electromagnetic stirrer for use on a continuous steel casting apparatus, comprising:

a coil assembly which further comprises a pair of exciting coils each formed by folding into a cage form a hollow conductor interiorly defining a cooling water passage, each of said pair of exciting coils of cage form having first a pair of opposingly spaced vertical side portions each comprising a plurality of parallel upright coil portions, a second pair of upper horizontal turn portions comprising a plurality of horizontal coil portions connecting upper ends of said upright coil portions in said opposing side portions and turned in parallel relation with each other and in the form of earflaps around the opposite sides of a casting mold or a continuously cast strand, and a third pair of lower horizontal turn portions comprising a plurality of horizontal coil portions connecting lower ends of said upright coil portions in said opposing side portions and turned in parallel relation with each other and in the form of earflaps around the opposite sides of the casting mold or the continuously cast strand, wherein said coils of cage form are disposed one in the other with the respective upper and lower horizontal turn portions in overlapping relation and with the vertical side portions of the two coils disposed perpendicular to each other to form four upright sides of the coil assembly;

an iron core mounted around said upright side portions and between said upper and lower horizontal turn portions of said coils of cage form; and means for applying a dual-phase alternate current with a phase differential of approximately $\pi/2$ in electrical angle to each of said coils of cage form.

2. An electromagnetic stirrer as set forth in claim 1, wherein said upper and lower horizontal turn portions of said coils of cage form are arranged in a plurality of layers.

* * * * *